US008308821B2

(12) United States Patent
Berkhout et al.

(10) Patent No.: US 8,308,821 B2
(45) Date of Patent: Nov. 13, 2012

(54) PROCESS FOR TREATING ANIMAL SKINS

(75) Inventors: Hermanus Johannus Berkhout, Apeldoorn (NL); Jose Ramon Garcia Del Rio, Esplugas de Llobregat (ES)

(73) Assignees: Akzo Nobel N.V., Arnhem (NL); Gases Research Innovation and Technology S.L., Barcelona (ES)

( * ) Notice: Subject to any disclaimer, the term of this patent is extended or adjusted under 35 U.S.C. 154(b) by 4 days.

(21) Appl. No.: 12/478,651

(22) Filed: Jun. 4, 2009

(65) Prior Publication Data

US 2009/0293201 A1 Dec. 3, 2009

Related U.S. Application Data

(63) Continuation of application No. 10/569,608, filed as application No. PCT/EP2004/014155 on Dec. 9, 2004, now abandoned.

(60) Provisional application No. 60/548,174, filed on Mar. 1, 2004.

(30) Foreign Application Priority Data

Dec. 17, 2003 (EP) ..... 03078900

(51) Int. Cl.
*C14C 1/00* (2006.01)
*C14C 1/08* (2006.01)
*C14B 1/26* (2006.01)

(52) U.S. Cl. ..... 8/94.18; 8/94.1 D; 8/94.15; 8/94.16; 8/94.21; 8/94.22; 8/94.23; 8/142; 252/8.57; 435/265

(58) Field of Classification Search ..... 8/94.15, 8/94.16, 94.18, 142, 94.21, 94.22, 94.23; 426/614, 650; 252/8.57; 435/265
See application file for complete search history.

(56) References Cited

U.S. PATENT DOCUMENTS

| | | | | | |
|---|---|---|---|---|---|
| 2,158,627 | A | * | 5/1939 | Kritchevsky | 8/94.18 |
| 3,444,625 | A | | 5/1969 | Giella et al. | |
| 3,795,750 | A | | 3/1974 | Levine | |
| 4,069,351 | A | | 1/1978 | Yano et al. | |
| 4,234,619 | A | * | 11/1980 | Yano et al. | 426/614 |
| 4,390,339 | A | * | 6/1983 | Taniguchi et al. | 8/94.18 |
| 4,443,221 | A | | 4/1984 | May et al. | |
| 5,306,435 | A | * | 4/1994 | Ishikawa et al. | 252/8.57 |
| 5,391,784 | A | * | 2/1995 | Brehn et al. | 554/98 |
| 5,525,120 | A | * | 6/1996 | Zauns-Huber et al. | 8/94.18 |
| 5,567,205 | A | | 10/1996 | Counts et al. | |
| 5,612,303 | A | | 3/1997 | Takayanagi et al. | |
| 5,868,798 | A | | 2/1999 | Anderson et al. | |
| 6,092,301 | A | * | 7/2000 | Komanowsky | 34/263 |
| 6,133,372 | A | | 10/2000 | Lohmann et al. | |
| 6,395,040 | B1 | | 5/2002 | Tulgar | |
| 6,491,730 | B1 | | 12/2002 | Cauble, Jr. et al. | |
| 2006/0135921 | A1 | | 6/2006 | Wiercinski et al. | |
| 2007/0124868 | A1 | | 6/2007 | Buehler et al. | |

FOREIGN PATENT DOCUMENTS

| | | |
|---|---|---|
| DE | 25 22 902 | 11/1976 |
| DE | 33 12 840 | 10/1984 |
| DE | 38 12 454 | 10/1989 |
| DE | 196 11 076 | 10/1997 |
| DE | 100 05 669 | 8/2001 |
| EP | 0 448 948 | 12/1994 |
| GB | 1 237 928 | 7/1971 |
| GB | 1 237 929 | 7/1971 |
| GB | 1 548 947 | 7/1979 |
| GB | 1 549 028 | 7/1979 |
| GB | 2 201 960 | 9/1988 |
| JP | 63-216480 | 9/1988 |
| JP | 02-123200 | 5/1990 |
| NL | 68 160 68 | 5/1970 |
| WO | WO 93/18188 | 9/1993 |

OTHER PUBLICATIONS

Smejkal P. et al., "Degreasing of Skin and Furs", *The Journal of the American Leather Chemists Association*, vol. 87, No. 10, p. 400, Oct. 1992.
International Standard, "Determination of Matter Soluble in Dichloromethane", ISO 4048-1977.
International Search Report and Written Opinion, PCT International Application No. PCT/EP2004/014155, dated Apr. 18, 2005.

* cited by examiner

*Primary Examiner* — Bijan Ahvazi
(74) *Attorney, Agent, or Firm* — Kenyon & Kenyon LLP

(57) ABSTRACT

The present invention pertains to a process for decreasing and/or drying skins which comprises contacting the skins to be degreased and/or dried with one or more extractor solvents which are able to dissolve both fat and water. Preferably, the extractor solvent is selected from the group consisting of dimethyl ether (DME), methylal, dioxolane, diethyl ether, methyl ethyl ketone, ethanol, propanol, and isopropanol. Most preferably, the extractor solvent is DME.

14 Claims, 1 Drawing Sheet

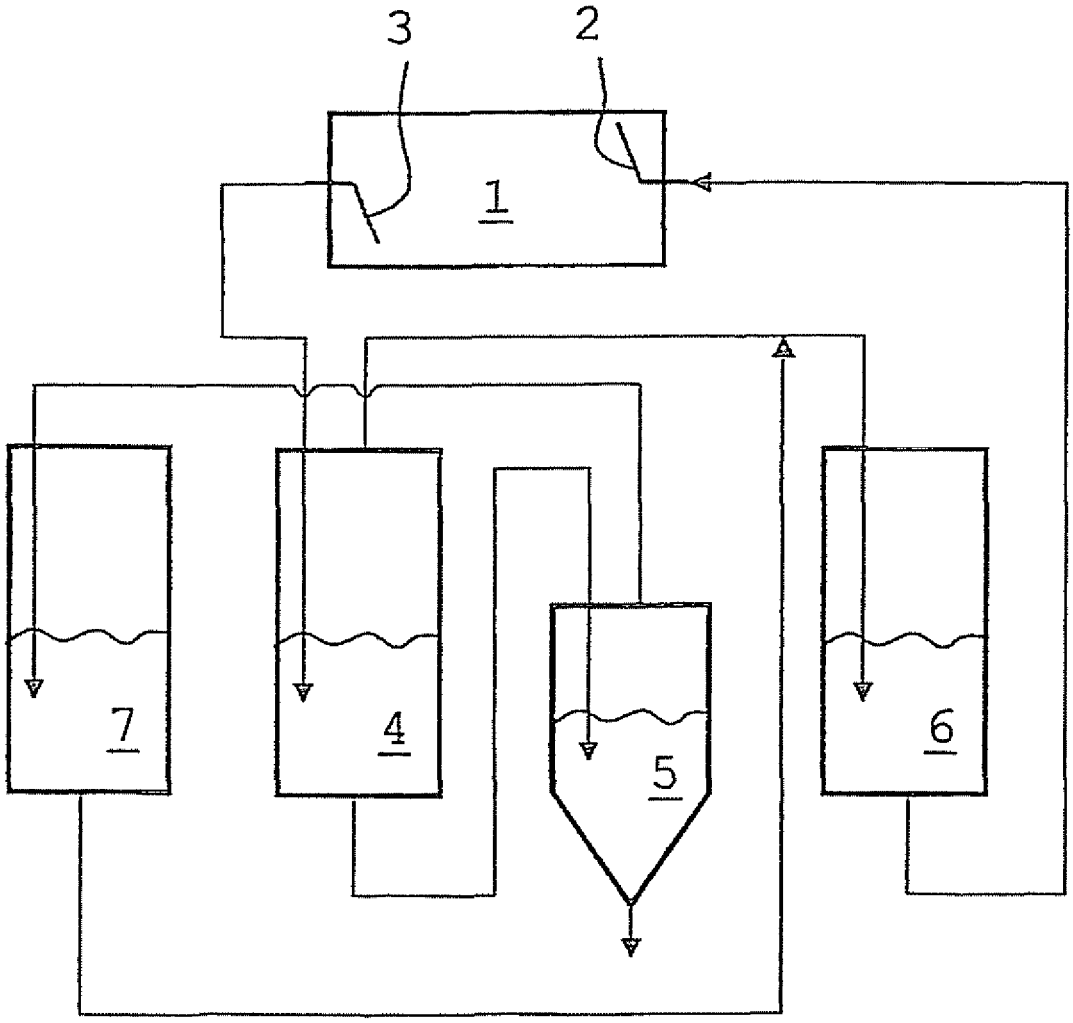
3
2
1
7
4
5
6

PROCESS FOR TREATING ANIMAL SKINS

CROSS-REFERENCE TO RELATED APPLICATION

This application is a continuation of U.S. patent application Ser. No. 10/569,608 filed Apr. 20, 2006 ABN which is the National Phase of PCT International Patent Application No. PCT/EP2004/014155, having an international filing date of Dec. 9, 2004, and claims the benefit of U.S. Provisional Application No. 60/548,174 filed Mar. 1, 2004 each of which are expressly incorporated in their entireties by reference thereto.

FIELD OF THE INVENTION

The present invention relates to a process for treating animal skins. More particularly, the present invention pertains to a process for degreasing and/or drying skins, hides, or leathers. The so-treated animal skins can be used in a conventional way, for example for making tanned leathers.

BACKGROUND

Besides methods using perchlorinated or trichlorinated solvents, one of the most commonly used methods to degrease wet skins is treating these skins with organic solvents and non-ionic and/or anionic detergents in a drum in an aqueous environment to emulsify fats. DE-OS 25 22 902, for example, describes degreasing compositions containing non-ionic and/or anionic surfactants as auxiliaries in an alcohol-based solvent. WO 93/18188 describes the use of degreasing agents based on non-ionic emulsifiers of the fatty alcohol alkoxylate type for degreasing skins, hides, and leathers. Said non-ionic emulsifiers contain a mixture of (a) $C_{12}$-$C_{18}$ fatty alcohol ethoxylates with an average of more than 6 EO groups in the molecule and (b) first-runnings fatty alcohol ethoxlates with more than 3 EO groups in the molecule, with (i) the fatty alcohols on which components (a) and (b) are based having an iodine number of under 10 and (ii) component (b) being present in a quantity of 2 to 10% by weight, in relation to the sum of (a) and (b).

A major disadvantage of these processes, however, is that the generated waste water will contain detergents, fats, and salts which are difficult to biodegrade and/or recycle. Another disadvantage is that the result reached by this method is not as efficient as with methods using perchlorinated or trichlorinated solvents.

Another degreasing method for wet skins is to treat these skins with hydrocarbons, such as derivatives of petroleum, white spirit, and nonyl phenol. A disadvantage of these degreasing methods is that water does not dissolve in the solvents employed. Hence the skins have to be dried in a separate process step. Besides, with said degreasing methods highly polluted waste water is generated comprising int. al. fats, hair, flesh remains, salts, and hydrocarbons. Dry skins, on the other hand, are generally degreased by using chlorinated solvents such as PER (tetrachloroethylene) and TRI (trichloroethylene). However, these solvents are known to be highly undesired in respect of human health as well as from an environmental point of view.

Processes for drying skins are for example described in U.S. Pat. No. 3,444,625. This document relates to processes in which water is removed from water-containing hides and skins by extraction with organic solvents such as, for example, formal, acetone, chloroform, or dichloromethane. A disadvantage of these processes, however, is that the skins have to be degreased in a separate step.

SUMMARY OF THE INVENTION

It is an object of the present invention to provide an efficient alternative to the current techniques used to eliminate natural fat contained in dry or wet skins, one which is less toxic and/or causes less environmental pollution while having the additional advantage that water contained in the skins can be extracted along with the fat.

The object of the invention is realised by providing a process for degreasing and/or drying animal skins comprising the step of contacting the skins with one or more extractor solvents. By the term "extractor solvent" is meant an organic solvent which is capable of dissolving both fats and water. It is noted that the term "skins" often refers to the skins of smaller animals, such as a pig, calf, or sheep, while the term "hides" refers to the skins of larger animals, such as a cow or horse. The term "skins", though, is also used generically in the art to describe all animal skins, as it is also intended to do hereinafter.

BRIEF DESCRIPTION OF THE DRAWINGS

FIG. 1 shows an example of a suitable configuration of a reactor and associated recycling system for carrying out the process according to the present invention.

DETAILED DESCRIPTION

The extractor solvent according to the present invention preferably comprises at least one solvent selected from the group consisting of dimethyl ether (DME), methylal, dioxolane, diethyl ether, and methyl ethyl ketone. Because of the ease of their recovery and for safety reasons, preferably those solvents are used which are gaseous at atmospheric pressure at room temperature. Preferably, a mixture of extractor solvents is used which comprises at least 10 wt %, more preferably at least 15 wt %, and most preferably at least 25 wt % of DME, based on the total amount of extractor solvents. Preferably, said mixture of extractor solvents besides DME comprises at least one extractor solvent selected from the group consisting of methylal, dioxolane, diethyl ether, methyl ethyl ketone, ethanol, propanol, and isopropanol, and more preferably, at least one extractor solvent selected from the group consisting of mehtylal, dioxolane, diethyl ether, and methyl ethyl ketone. Even more preferably, a mixture of methylal and dimethyl ether is used. However, most preferably dimethyl ether is used as the extractor solvent.

Although this is less preferred, the above-mentioned extractor solvents or mixtures of extractor solvents can also be used as a mixture with one or more fat-miscible solvents, such as esters, including methyl acetate, ethyl acetate and propyl acetate; hydrocarbons, including n-pentane, i-pentane, cyclopentane, hexane, cyclohexane, heptane, white spirit, and petroleum ether; glycols, including 2-ethoxyethanol and 2-butoxyethanol; or chlorinated, brominated, and/or fluorinated hydrocarbons, including $CHF_2CH_2CF_3$, $CF_3CHFCF_3$, $CF_3Br$, and $CF_3CH_2F$. Preferably, said mixture comprises at least 35 wt %, more preferably at least 50 wt %, and most preferably at least 70 wt % of extractor solvent(s) according to the present invention, based on the total amount of solvents used. More preferably, said mixture comprises at least 10 wt % of DME, based on the total amount of solvents used.

Dimethyl ether (DME) is gaseous under standard atmospheric conditions. It can be readily liquefied by cooling to below −25° C. at atmospheric pressure or by compression to above about 5 atmospheric pressure at room temperature. Liquefied dimethyl ether has the advantage that it readily dissolves most fats and also dissolves about 6.3 wt % by weight of water at 20° C. It has a specific gravity, which is the density of a substance divided by the density of water, of 0.661, and a latent heat of vaporisation of 96.6 cal/g.

The process according to the present invention can be used as an initial step to remove fat and/or water from fresh skins or from wet skins, but it can also be a degreasing step in a subsequent tanning process. Thus, the skins which can be used in the process according to the present invention can be any skins which are also suitable for conventional degreasing and/or drying processes.

It is noted, that the term "skins" as used throughout this document is meant to denominate fresh, wet, and dry animal skins. The term "fresh skin" denotes a skin which is directly obtained from a slaughterhouse, whereas the term "wet skin" denotes a skin which has already gone through one or more of the processes for preparing tanned leathers, such as pickling, curing, liming, unhairing, washing, shearing wool, depilation, or scraping flesh. The term "dry skin" denotes a skin which has undergone a chemical preservation treatment such as, for example, salting and/or a physical preservation treatment such as, for example, drying, cooling, or freezing.

Thus, examples of skins suitable for being treated according to the process of the present invention include skins which are not salted or treated, obtained from animal flaying or from processes for transforming leather; fresh-salted skins, semi-cured skins, i.e. skins which are partially dried and optionally cooled, or semi-elaborated skins, i.e. skins which have already undergone some of the processes for preparing tanned leathers; finished skins, i.e. skins that have undergone all steps of the tanning process except for the degreasing and/or the drying step; skins that are manufactured articles which should undergo a similar process to the one called dry cleaning; and skins obtained from sheepskin tanneries which may degrease the skins prior to or after pickling.

The word "tanning" as used in this specification is used in its conventional meaning, i.e. denoting the general process of converting raw animal skins into leather.

The skins to be degreased according to the process of the present invention are preferably selected from the group consisting of sheepskins, cowhides, goatskins, and pigskins. The skins of sheep, goats, or pigs are to be degreased in a higher proportion than cowhides. It is noted that the skilled person will understand that the term cowhide also includes bullhide.

The process is similar when dealing with fresh, dry, semi-elaborated or finished skins. The fact that there may be chemical products in the skins such as, for example, salt, acids, alkaline detergents normally does not adversely affect the degreasing and/or drying process with the above-mentioned exactor solvents and therefore these skins can be employed in the degreasing and/or drying process according to the present invention. Moreover, those skilled in the art will recognise that the process according to the invention is open to conventional variations as required by special situation in the tannery where the process is to be performed or for the treatment of special skins which are to be degreased and/or dried.

The extraction process according to the present invention can be performed in any reactor or vessel conventionally used in degreasing processes of skins, pelts, hides, or leathers. In a preferred embodiment, said process is performed under pressure in a conventional reactor wherein the content is static and which contains proper systems to wet the skins. In the so-called static reactor, the skins can be left folded at the bottom of the reactor or in a basket which is then introduced to the reactor. However, some dirt originating from parts of the reactor which are inaccessible to any cleaning and from pipes might adhere to the skins. Moreover, some water and/or dirt might accumulate in the folds. Therefore, in a preferred embodiment of the present invention, the skins are placed in the static reactor in a vertical position while their surface is wetted from top to bottom with the one or more extractor solvents, or in another position where they can be completely wetted by the one or more extractor solvents.

In another preferred embodiment, said process is performed in a conventional rotatory reactor. The advantage of a rotatory reactor is that the interface between the content interaction of the skin and the extractor solvent(s) will be improved by the spinning, swinging or vibrating movement, thus reducing extraction times and activating the process.

The total amount of solvent(s) used in the degreasing and/or drying process according to the present invention, the pressure applied, and the temperature in the reactor are chosen on the basis of the total weight of the skins, their fat content to be removed, the analysed content of water contained in the skins, whether any fat-miscible solvents are used or not, and possible previous treatments. For example, the optimum pressure to be applied is dependent on the manner of dosage of extractor solvent and on the amount(s) and type(s) of extractor solvent(s) used. However, typically a pressure of between 1 to 12 bar is applied, preferably of less than 10 bar, and most preferably of less than 8 bar.

In order to remove fat in a most effective way, the temperature in the reactor is preferably controlled to be less than 50° C., more preferably less than 45° C., and most preferably less than 40° C. The temperature applied preferably is higher than 5° C., more preferably higher than 10° C., and most preferably higher than 15° C. This can be conveniently achieved by controlling the temperature of a recycle stream to the reactor or by heating or cooling the reactor itself. The high extractive effectiveness of the one or more extractor solvents according to the present invention allows working in a wide range of temperatures, but preferably temperatures above room temperature are applied. Most preferably, the temperature is in the range of from 20° C. to 35° C. The temperature is preferably controlled within 5% of the set point in order to obtain a reproducible process.

Before introducing the one or more extractor solvents into the reactor and in order to ensure safety, preferably appropriate measures are taken, such as introducing an inert atmosphere in the reactor before the skins are contacted with the one or more extractor solvents, optionally in combination with one or more fat-miscible solvents. More preferably, the reactor remains under an inert atmosphere during most or all of the degreasing and/or drying process. In a preferred embodiment, $CO_2$ or $N_2$ or other inert or extinguisher gases are used for this purpose. Maintaining a constant pressure by means of the inert gas during the extraction process provides additional safety and it adds energy to the process.

During the degreasing and/or drying treatment the one or more extractor solvents, optionally in combination with one or more fat-miscible solvents according to the present invention, can be dosed continuously to the reactor, meaning that for a certain period of time the combined solvents are continuously added to the reactor. Dosing of the extractor solvent (s) to the reactor can also be done intermittently during the operation, in which case the skilled person will be able to select the optimum interval times and the optimum amounts of extractor solvent(s), and optionally the optimum of fat-miscible solvents(s), to be dosed by routine experimentation.

A combination of these techniques is also possible. Examples of a combination of such techniques include, for instance, a process wherein the exactor solvent(s), and optionally the fat-miscible solvent(s)is/are first added continuously, then the addition is stopped, and then again it/they is/are added continuously. A continuous dosing operation, however, is most preferred. In a particularly preferred embodiment, the extractor solvent(s) and optionally the fat-miscible solvent(s) is/are dosed while a liquid comprising extractor solvent(s), optionally fat-miscible solvent(s), water, and fat, hereinafter referred to as the extractor liquid, is removed from the reactor. In an even more preferred embodiment, the extractor liquid thus isolated is purified. Most preferably, the obtained extractor solvent(s) and optionally the obtained fat-miscible solvents is/are then recycled to the reactor.

If it is desired to retain a certain degree of humidity in the skins, for example for reasons of flexibility of the skin, or when this is useful for subsequent steps in the process to make leather, a small amount of water may be added to the extractor solvent(s) and/or to the fat-miscible solvent(s), if used. In a particularly preferred embodiment, the required amount of water is added to the extractor solvent(s) which are recycled to the reactor. Thus, by varying the amount of water in this/these solvent(s), the degree of drying can easily be regulated and a skin having the desired degree of humidity is obtained.

Once the skins have been defatted and dried to the desired extent, the extractor liquid is removed from the reactor, preferably in a closed circuit. Typically, this liquid will int. al. contain residues of fat and proteins. Preferably, the extractor solvent(s) is/are isolated from the liquid, and most preferably is/are isolated from the liquid, and most preferably it/they is/are recycled in the process. The obtained skins will contain a certain amount of extractor solvent(s) and optionally fat-miscible solvent(s) absorbed therein. This/these solvent(s) is/are eliminated using temperature and/or vacuum control, or by stripping with an inert gas. Preferably, this/these solvent(s) absorbed in the skin are evaporated and subsequently recovered. Most preferably, the combined solvents thus recovered are recycled to the reactor. The process will be considered finished when the total amount of solvents still absorbed in the skins is less than 5 g per kg of treated skin, more preferably less than 2 g, even more preferably less than 1 g, and most preferably less than 0.5 g per kg of treated skin, i.e as determined by taking samples of the evaporated gases.

When DME is used as the extractor solvent or as one of the extractor solvents employed in the degreasing and/or drying process according to the present invention, the presence of water and its solubility in DME improve the safety of the process as regards flammability, because the minimum and maximum values of flammability are reduced. Thanks to its high diffusivity, DME penetrates the skin easily, solving the water and fat contained therein, under the formation of an extractor liquid which besides water and fats will basically contain proteins, etc. without polluting residues.

Preferably, the skins are contacted with the one or more extractor solvents and optionally the fat-miscible solvents according to the present invention, for a fixed period of time. The desired extraction time depends on the fat and water contents in the skins, the difficulty of extracting them, and the desired result. Typically, the extraction time is less than 10 hours, more preferably less than 8 hours, even more preferably less than 4 hours, and most preferably less than 1 hour. Preferably, the skins are contacted with the extractor solvent (s), and optionally the fat-miscible solvents, for more than 10 minutes, more preferably more than 20 minutes, and most preferably more than 30 minutes. In a preferred embodiment, there is the possibility of taking samples of the extractor liquid during the extraction process to determine the point at which the skins are sufficiently degreased and/or dried by means of conventional techniques such as, for example, using the Karl Fisher determination method of the percentage of water or by determining the fat and water contents by evaporation of the extractor solvent(s) and subsequent weighing of the thus obtained residue. Normally, when the type of skin to be treated is known, i.e the breed of animal as well as the region the animal came from and preferably also its feed, the skilled person can easily find out the fat content contained in the skin. For example, it is known to the skilled person that the skin of Spanish merino sheep generally contains approximately 12% fat, while the skin of Australian and English sheep usually contains more than 30% fat. Furthermore, it is generally known that pigskins have a high fat content.

With the process according to the present invention skins can be obtained which are practically dry and perfectly clean. The process according to the present invention allows the skins to be degreased to a percentage of preferably more than 50 wt %, more preferably more than 75 wt %, even more preferably more than 90 wt %, and most preferably more than 98 wt %, based on the total amount of fat originally contained in the fresh skins. The process according to the present invention allows skins which have not been subjected to a pre-drying step to be dried to a percentage of preferably more than 30 wt %, more preferably more than 50 wt %, even more preferably more than 75 wt %, and most preferably more than 90 wt %, based on the total amount of water originally contained in the fresh skins. For some purposes, however, it is preferred to maintain a certain humidity level in the skins (vide supra).

As discussed above, the required amount of extractor solvent(s) to achieve satisfactory percentages of degreasing and/or drying is dependent on the type(s) of extractor solvent(s) used, the fat and water contents in the skins to be treated, whether or not the extractor solvent(s) is/are used in combination with fat-miscible solvents according to the invention, and the extent to which one wishes the skins to be degreased and/or dried. However, in general, the use of an amount of extractor solvent(s) of 40 liters per kg of skin to be degreased and/or dried, more preferably of 20 liters, and most preferably of less than 5 liters per kg of skin to be degreased and/or dried will suffice for obtaining a skin which is practically dry, i.e. more than 90 wt % of water based on the amount of water contained in the fresh skin has been removed, and perfectly clean, i.e. more than 98 wt % of fat based on the amount of fat contained in the fresh skin has been removed. However, it is noted that the longer the extraction times, the less solvent is needed to achieve the desired results.

Preferably, at least 0.5 liters of extractor solvent(s) per kg of skin to be degreased and/or dried are used, more preferably at least 0.75 liters, and most preferably at least 1 liter of extractor solvent(s) is used per kg of skin to be degreased and/or dried.

The present invention is elucidated by means of the following non-limiting Examples. Further, a preferred Example of a suitable configuration of a reactor and associated recycling system for carrying out the process according to the present invention is shown in the attached FIG. 1 and will be described below.

EXAMPLE 1

One fresh sheepskin and one fresh goatskin, obtained from a slaughterhouse, recently flayed, with the wool residue of the animal adhered, and dirty (not washed or treated) were left folded at the bottom of a metallic basket, which is the support for samples, in folds of 30×30 cm. The basket was then introduced to a static reactor with a content of 140 liters under a pressure of 4.1 bar. Subsequently, $CO_2$ gas was introduced into the reactor. The reactor was purged with dimethyl ether (DME) until the air and $CO_2$ gas were eliminated and a vacuum was created. The whole equipment was weighed. The equipment weighed 357 kg and the weight of the combined skins was calculated to be 2,240 g. Subsequently, 53 kg of DME were added in the liquid phase at a rate of 17 kg/min. The temperature was measured and the reactor was heated to 27° C. and kept at that temperature for a period time of 1 hour. During this hour, approximately 17 kg/min of extractor liquid comprising DME were removed from the bottom of the reactor and subsequently recycled to the top of the reactor by a pump with a flow rate of 17 kg/min. Thus, the skins were repeatedly washed with DME. After 1 hour, the reactor was emptied of DME and brought under a $CO_2$ atmosphere, and the combined gases were pulled away to a venting area. Subsequently, the skins were weighed. In a first weighing the skins weighed 1,790 g, due to the presence of absorbed DME. After six hours the absorbed DME had evaporated, and the skins weighed 1,640 g. This means a total loss of weight of 640 g of water and fat, which is 28.6% of the weight of the untreated skins.

By analysing the extractor liquid during the process, it was possible to calculate not only the quantity of dehydrated water, but also the fat removed. It was found that the extraction of fat was effective, i.e. more than 99% of the fat contained in the skin was removed.

EXAMPLE 2

A wet sheepskin and a wet goatskin called "double face" (clean and without flesh, untanned) with the wool cut to measure, were left folded at the bottom of a metallic basket, which is the support for samples, in folds of 30×30 cm and subsequently introduced to a static reactor of 140 liters. The skins together weighed 2,180 g. A similar procedure to the one described for Example 1 was followed. However, the recycling was omitted. Instead, four washes were carried out with 15 kg of DME in the pumping circuit. Each time, the injected DME was pumped in at a rate of 17 kg/min. After sixty minutes the reactor was emptied of DME and the skin was weighed. In a first weighing the skins weighed 1,630 g, due to the presence of absorbed DME. After twelve hours the absorbed DME had evaporated, and the skins weighed 1,270 g. This means a total loss of weight of 910 g of water and fat, which is 41.7% of the weight of the untreated skins.

The dried and degreased skins obtained with the procedures according to Examples 1 or 2 were practically dry, but since some water was still present in the folds, Examples 3 and 4 were performed while the skins were hanging and while their surfaces were wetted from top to bottom.

EXAMPLE 3

Two dry "double face" sheep- and goatskins were introduced (clean and without flesh, dried, untanned) with the wool cut to measure, in a static reactor of 140 liters. They were left hanging in vertical position and supported by the edges of a metallic basket. There were no folds wherein dirt and/or water could accumulate. The skins together weighed 1,230 g. The same procedure as the one described for Example 2 was followed. Hence, four washes were carried out each with 15 kg of DME in the pumping circuit, with the DME present in the reactor being replaced each time. Again, the injected DME was pumped in at a rate of 17 kg/min. New quantities of DME were introduced approximately every 15 minutes and samples of circulating DME were taken. After sixty minutes (time of pumping) the reactor was emptied of DME. Subsequently a vacuum was created for two hours and the skins were weighed. In a first weighing the skins weighed 1,030 g, due to the presence of absorbed DME. After two hours the absorbed DME had evaporated, and the skins weighed 1,040 g, because due to their hygroscopic properties they had absorbed some atmospheric moisture. This means a total loss of weight of 190 g of water and fat, which is 15.44% of the weight of the untreated skins. The skins were practically dry.

Analysis carried out on these skins via the Soxlet method in accordance with Standard IUC-4/ISO 4048 using methylene chloride showed that the treated goat- and sheepskins had a fat content below 1% and 2%, respectively.

A higher extractive effectiveness was observed in these dry skins than in the wet ones of Example 2.

EXAMPLE 4

Two small pieces of wet cowhide, i.e. a pickled cowhide and a cow pelt (clean and without flesh, wet, unhaired, untanned) of 560 g and 700 g weight, respectively, were left hanging in a vertical position, near the bottom of a metallic basket because of their small size, and supported by the edges of the basket. Subsequently, the metallic basket was introduced to a static reactor of 140 liters. There were no folds where dirt and/or water could accumulate. The same procedure as the one described in Example 2 was followed. Hence, four washes were carried out each with 15 kg of DME in the pumping circuit, with the DME being replaced each time as if it was introduced from a possible recycling installation. Again, the injected DME was pumped in at a rate of 17 kg/min. After sixty minutes (time of pumping) it was emptied of DME. Subsequently a vacuum was created for ten minutes and the skin was weighed. In a first weighing the skins weighed 270 g and 340 g, respectively. After two hours the weights of both skins were still the same. This means a total loss of weight of 290 g and 360 g, respectively, of water and fat, which is 48.2% and 51.4%, respectively.

Analysis carried out on these skins via the Soxlet method in accordance with Standard IUC-4/ISO 4048 using methylene chloride showed that the treated cowhides both had a fat content below 1%.

A preferred example of a suitable configuration of a reactor and associated recycling system for carrying out the process according to the present invention is shown in the attached FIG. 1.

This configuration comprises a static or rotary reactor 1, known in itself and sometimes also referred to as a "digester", for holding skins to be degreased and/or dried. The reactor 1 comprises an inlet 2 for fresh extractor solvent(s) and an outlet 3 for extractor liquid containing, e.g., residues of fat and proteins as well as water. The outlet 3 is connected, via a conduit, to a reboiler 4, equipped with a heating element (not shown). The bottom of the reboiler 4 is connected to a flash drum 5, while the top of the reboiler 4 is connected to the top of a collector/condenser 6 for the recovered extractor solvent (s), as will be explained below. Although the top of the flash drum 5 can in principle be connected directly to either the top of the reboiler 4 or the top of the collector 6, it is preferred that it is connected to a further vessel, in this example a recovery vessel 7. Such an additional vessel can be employed, e.g., to check whether any water or residues are still present in the extractor solvent coming form the flash drum 5. To close the circuit, the bottom of the collector 6 is connected to the inlet 2 of the reactor 1. Further, vessels 6 and 7 are each provided with a drain for removing recovered solvent(s) that should not be recycled.

If the extractor liquid contains DME, the recycling system is typically operated thus: skins are degreased and/or dried in the reactor 1 at approximately 25° C. and 4 bar; the liquid contents of the reactor 1 are pumped to the reboiler 4, where the extractor solvent(s) is/are distilled at a slightly higher temperature and pressure, e.g. approximately 35° C. and 6 bar; the vapour phase resulting from this distillation flows to the collector 6, where it condenses to a liquid at approximately 25° C. and 4 bar; the recovered extractor solvent(s) is/fed to the reactor 1.

If the amount of extracted fat and removed water in the reboiler 4 exceeds a pre-selected threshold, e.g. 50% of the content of the reboiler 4, the extracted fat and water are pumped to the flash drum 5. In the flash drum 5, the extractor solvent(s) is/are boiled or flashed off, e.g. at approximately 45° C. and 8 bar, and the resulting vapour phase flows to the recovery vessel 7, where it condenses under conditions similar to those in the collector 6. The condensed extractor solvent (s) is/are pumped to the collector 6 and fat residues and water are removed from the bottom of the flash drum 5 and collected in drums.

The process described above was found to be particularly efficacious in recovering and recycling DME and other extractor solvents.

What is claimed is:

1. A process for degreasing and/or drying animal skins which comprises contacting the skins to be degreased and/or dried with one or more extractor solvents comprising at least one solvent selected from the group consisting of dimethyl ether (DME), methylal, dioxolane, and diethyl ether, wherein the animal skins are degreased to a percentage of more than 50 wt %, based on the total amount of fat originally contained in the fresh animal skins.

2. The process according to claim 1 wherein the extractor solvent is dimethyl ether (DME) or a mixture of solvents comprising dimethyl ether (DME).

3. The process according to claim 2 wherein the mixture of solvents comprises at least 10 wt % of dimethyl ether (DME), based on the total amount of solvents.

4. The process according to claim 1 wherein the skins are selected from the group consisting of sheepskins, cowhides, goatskins, and pigskins.

5. The process according to claim 1 wherein the one or more extractor solvents are used in combination with one or more fat-miscible solvents selected from the group consisting of esters; hydrocarbons; glycols; and chlorinated, brominated, and/or fluorinated hydrocarbons.

6. The process according to claim 1 which is carried out in a static or rotatory reactor.

7. The process according to claim 1 which is carried out under a pressure of between 1 and 12 bar and at a temperature between 5° C. and 40° C.

8. The process according to claim 1 wherein the skins are contacted with the one or more extractor solvents for a period of time of between 10 min and 10 hours.

9. The process according to claim 1 wherein the skins are dried removing water to a percentage of more than 30 wt %, based on the total amount of water originally contained in the fresh skins.

10. The process according to claim 1 comprising the further steps of placing the skins to be degreased and/or dried in a reactor, bringing the reactor under an inert atmosphere, and contacting said skins with one or more extractor solvents by measuring out said extractor solvents continuously, intermittently, or a combination thereof, to the reactor.

11. The process according to claim 1 wherein the one or more extractor solvents are isolated after having been in contact with the skins and subsequently recycled.

12. The process according to claim 11 comprising the further steps of removing a liquid phase containing residues of fat and/or water from the reactor and transporting the solvent(s) to a first vessel, heating the solvent(s) in the first vessel, transporting the vapour phase resulting from this heating to a second vessel, condensing the vapour phase in the second vessel, and feeding the thus recovered solvent(s) to the reactor.

13. The process according to claim 12 comprising the further steps of removing the liquid phase from the first vessel and transporting it to a third vessel, boiling or flashing off extractor solvent(s) contained in the liquid phase, and feeding the extractor solvent(s) to the second vessel, ei ther directly or via a fourth vessel.

14. The process according to claim 1 wherein between 0.5 and 40 liters of extractor solvents are used per kg of skins.

* * * * *